United States Patent [19]

Gerz

[11] 4,190,102

[45] Feb. 26, 1980

[54] AIR COOLED CONDENSER INSTALLATION

[75] Inventor: Hans-Bernd Gerz, Bochum, Fed. Rep. of Germany

[73] Assignee: GEA Luftkuhlergesellschaft Happel GmbH & Co. KG, Herne, Fed. Rep. of Germany

[21] Appl. No.: 895,660

[22] Filed: Apr. 12, 1978

[30] Foreign Application Priority Data

Jan. 4, 1978 [DE] Fed. Rep. of Germany ..... 2800287

[51] Int. Cl.[2] ..... F28B 7/00

[52] U.S. Cl. ..... 165/113; 165/114; 165/139; 165/144; 165/174

[58] Field of Search ..... 165/113, 110, 111, 114, 165/144, 145, 139, 174

[56] References Cited

U.S. PATENT DOCUMENTS

| | | | |
|---|---|---|---|
| 3,543,843 | 12/1970 | Gunter | 165/113 |
| 3,710,854 | 1/1973 | Staub | 165/111 |

FOREIGN PATENT DOCUMENTS

| | | | |
|---|---|---|---|
| 2215369 | 10/1973 | Fed. Rep. of Germany | 165/113 |
| 525317 | 8/1940 | United Kingdom | 165/113 |

*Primary Examiner*—Sheldon Richter

*Attorney, Agent, or Firm*—Michael J. Striker

[57] ABSTRACT

An air cooled condenser installation comprising a first group of heat exchange elements including a plurality of rows of upright tubes impinged by a stream of cooling air and connected at upper and lower open ends by an upper manifold respectively, a lower collecting chamber to each other, and a steam conduit communcating with the upper manifold so that the steam flows in downward direction through the tubes and partly condenses therein with the condensate flowing in the same direction, and a second group of heat exchange elements including a second plurality of upright tubes impinged by a second stream of cooling air and connected at upper and lower open ends respectively by an upper chamber and a lower chamber, and a conduit connecting said lower collecting chamber of said first group of heat exchange elements with the lower chamber of the second group of heat exchange elements so that steam which has not been condensed in the first group of heat exchange elements will flow in upward direction through the second plurality of tubes to thereby condense, with the condensate flowing in downward direction, in opposition to the flow of the steam.

8 Claims, 1 Drawing Figure

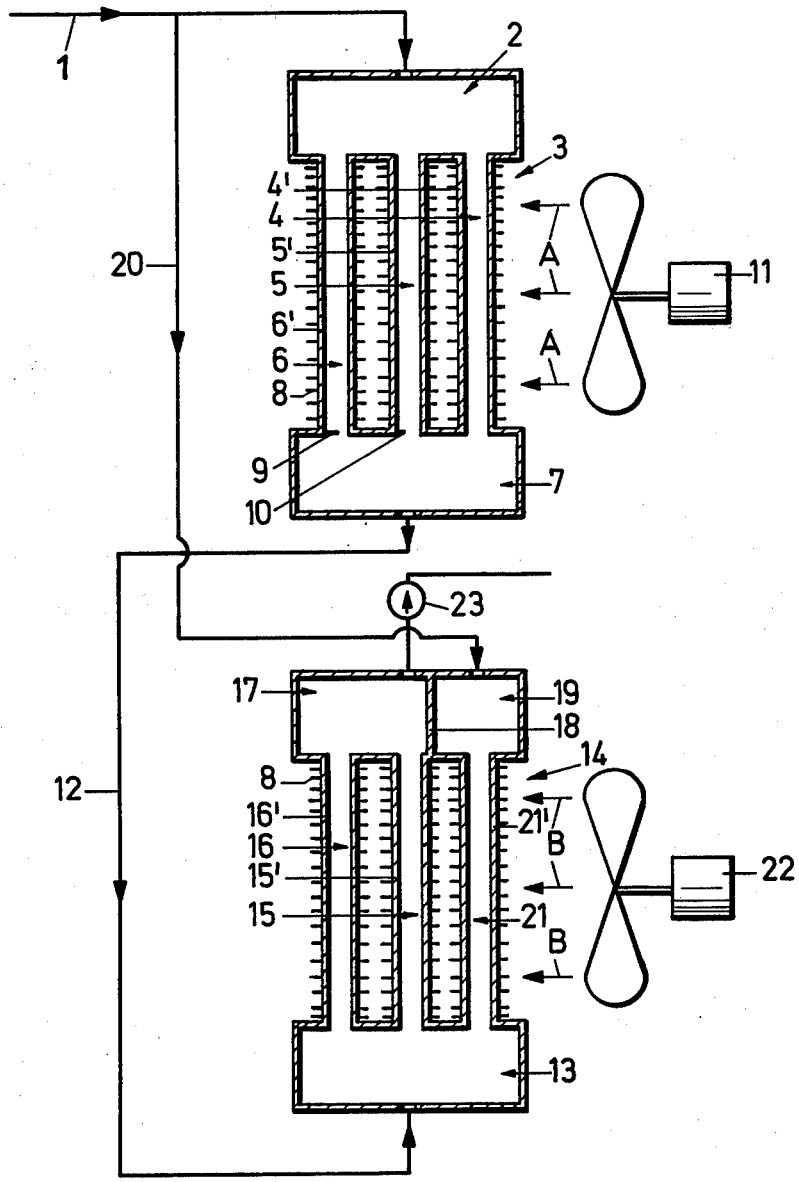
1
2
3
4'
4
5'
5
6'
6
8
20
A
A
11
9
10
7
23
17
19
18
14
8
12
16'
16
15'
15
21'
B
21
B
22
13

AIR COOLED CONDENSER INSTALLATION

BACKGROUND OF THE INVENTION

The present invention relates to an air cooled condenser installation comprising a first group of heat exchange elements including a plurality of rows of upright tubes impinged by a stream of cooling air and connected at upper and lower open ends by an upper manifold, respectively a lower collecting chamber to each other and a steam conduit communicating with the upper manifold so that the steam flows in downward direction through the tubes and partly condenses, with the condensate flowing in the same direction as the steam, and a second group of heat exchange elements including a second plurality of upright tubes impinged by a second stream of cooling air and connected at upper and lower open ends respectively by an upper chamber and a lower chamber, and a conduit connecting said lower collecting chamber of the first group of heat exchange elements with the lower chamber of said second group of heat exchange elements so that steam which has not been condensed in the first group of heat exchange elements will flow in upward direction through the second plurality of tubes to thereby condense, while the condensate will flow in downward direction in opposition to the flow of steam.

Air cooled condenser installations of the aforementioned kind may be cooled by the surrounding atmosphere or by forced air streams. The heat exchange elements are usually arranged in form of a gable roof. The steam to be condensed is passed first in downward direction through such a heat exchange element or a plurality of such heat exchange elements so that the condensate forming during condensation of the steam will pass in the same direction as the steam, that is in downward direction through the heat exchange element or elements. In order to prevent freezing during operation in wintertime, surplus steam is passed through the heat exchange elements through which steam and condensate flow in the same downward direction and the steam which does not condensate is subsequently condensed in a heat exchange element or a plurality of heat exchange elements in which this surplus steam flows in upward direction to condensate, with the condensate thus formed flowing in downward direction, that is in opposition to the flow of the steam.

If the plurality of heat exchange elements are connected in form of gable roof to each other, the cooling air is blown from below against these heat exchange elements. On the other hand, the heat exchange elements, formed by tubes provided at the outer surfaces thereof with cooling ribs, may also be arranged substantially vertical, in which case the stream of cooling air is passed in a horizontal direction against the heat exchange elements. The heat exchange elements may be arranged in a plurality of rows spaced from each other in direction of the cooling air stream.

It is known that in heat exchange elements in which the condensate flows in a direction opposite to the steam passing therethrough, it is possible that at temperatures below 0° C. hoar frost may form in the upper portions of these heat exchange elements. This formation of hoar frost is due to the fact that in these upper portions of the heat exchange elements a steam-air mixture is present, with a relatively high percentage of air, so that the condensating process will not take place any more in these upper end portions. The moisture contained in the vapor air mixture precipitates therefore at temperatures below 0° C. in the form of hoar frost on the inner surfaces of the tubes through which steam and condensate passes in opposite directions.

At unfavorable operating conditions, for instance during continuous operation at low temperatures, as well as continuous loading of the installation, the danger exists that the thickness of the layer of hoar frost increases more and more until the open cross-section of the tubes, through which steam and condensate passes in opposite direction, is narrowed in such a manner that the non-condensing gases, which accumulate during the condensation process, cannot be completely evacuated. The primary result is an accumulation of air in the heat exchange elements in which steam and condensate pass in opposite directions. Even though these heat exchange elements will not be destroyed, they will not take part any longer in the condensation process and the output is thereby reduced.

A further result of the accumulation of air in part of the heat exchanger tubes, through which condensate and steam pass in opposite direction, may be that now it is not possible any longer to draw through the still acting tubes the necessary amount of steam through the heat exchange element with tubes through which steam and condensate pass in the same direction in order to prevent formation of feared dead zones in the lower portion of the last-mentioned tubes. Such dead zones in the tubes through which steam and condensate pass in the same direction may cause freezing and formation of ice in these tubes, which could lead to damage of the same.

This disadvantage of air cooled condenser installation provided with a first group of heat exchange elements including a plurality of tubes through which steam and condensate pass in the same direction and a second plurality of tubes through which steam and condensate pass in the opposite direction has up to now been obviated in that the heat exchange elements with the tubes through which steam and condensate pass in opposite direction are only intermittently impinged by cooling air. If forced streams of cooling air are used, the ventilators producing the forced cooling air streams are shut down for short moments in intermittent time intervals so that the tubes through which steam and condensate pass in opposite direction are warmed up so that eventually formed hoar frost may be reduced. In the case of cooling the condenser installation by the surrounding air the same effect may be produced, for instance, by covering some of the heat exchange elements through which steam and condensate pass in opposite direction by louvres.

A disadvantage of such an arrangement is that pressure variations will result in the condenser installation, due to the alternating operation of the air cooling during forced air cooling or natural air cooling. The additional work of the operators may be reduced by automating the switching on and off of the ventilators, respectively the actuation of the louvres. However, evidently such an automation can be obtained only with an increased expenditure for control devices.

SUMMARY OF THE INVENTION

It is an object of the present invention to provide an air cooled condenser installation of the aforementioned kind in which, without interruption of the cooling air stream to the heat exchange elements, formation of hoar frost in the heat exchange elements through which steam and condensate pass in opposite direction is positively prevented.

With these and other objects in view, which will become apparent as the description proceeds, the air cooled condenser installation according to the present invention mainly comprises first heat exchange means comprising a first plurality of rows of substantially upright tubes adapted to be impinged by a stream of cooling air in a direction transverse to the longitudinal direction of the tubes, an uoright manifold communicating with upper open ends of the tubes, a lower collecting chamber communicating with lower open ends of the tubes, a steam conduit communicating with the upper manifold so that steam passing therethrough flows downwardly through the tubes to partly condense with the thus-formed condensate flowing likewise downwardly into said collecting chamber, second heat exchange means comprising a plurality of second rows of substantially upright tubes adapted to be impinged by a second stream of cooling air flowing in a direction transverse to the elongation thereof, a lower distribution chamber communicating with lower open ends of the tubes of the second rows, and upper distribution chamber communicating with upper open ends of the tubes of the second rows, a connecting steam conduit connecting the lower collecting chamber with the lower distribution chamber so that steam which has not been condensed in the first heat exchange means flows upwardly through the tubes of the second rows of tubes from the lower to the upper distribution chamber to thereby condense with the thus-formed condensate flowing in countercurrent direction to the steam, said second heat exchange means including further a plurality of additional substantially upright tubes arranged in front of the tubes of the second rows to be first impinged by the second stream of cooling air, the additional tubes communicating at lower open ends thereof with the lower distribution chamber, and a branch conduit branching off from the steam conduit and communicating with upper open ends of the additional tubes so that steam passing therethrough flows downwardly through the additional tubes and condenses with the thus-formed condensate flowing in the same direction as the steam.

In such an arrangement in which tubes through which steam and vapor flows in the same direction are arranged in front of tubes in which steam and condensate flows in opposite directions, the air streams passing the latter tubes are heated up so that the cooling air passing the tubes through which steam and condensate flows in opposite direction are under all circumstances, that is also by outer temperatures below 0° C., heated up to a temperature above the freezing point so that an undercooling of the tubes through which steam and condensate flow in opposite direction with the possibility of forming hoar frost, in the interior thereof, is positively avoided. The tubes through which steam and condensate flow in opposite direction partake therefore fully in the desired condensating process to thereby assure the attainment of the desired condensation output. Preferably the tubes which are arranged in front of the tubes through which steam and condensate flow in opposite direction are arranged to extend in height and width through the same distance as the tubes located in the direction of flow of the cooling air behind the same.

According to the present invention it is further advantageous that the tubes of the second heat exchange means through which steam and condensate flow in opposite direction are combined into one unit with the additional tubes arranged in front of the same and in which steam and condensate flow in the same direction. In this case the upper distribution chamber, with which the upper open ends of both groups of tubes communicate, is divided into two compartments and the compartment with which the upper open ends of the tubes through which steam and condensate flow in the same direction is connected to the main steam conduit, whereas the lower distribution chamber for the condensate is common to both groups of tubes.

According to a further feature of the present invention throttles are arranged in the tubes of the first heat exchanger means, with the exception of the tubes in the row which is first impinged by the stream of cooling air. These throttles are arranged adjacent the lower collection chamber of these tubes and the open cross-section of the throttles in each row of tubes decreases in the direction of the flow of cooling air from one to the next row.

In other words, the tubes of the first heat exchange means through which steam and condensate flow in the same direction and which are first impinged by the stream of cooling air are not provided with throttles. In these tubes the condensation is maintained over the total length of the tubes to avoid forming of dead zones. The tubes following in the direction of the stream of cooling air are then provided with throttles of different cross-sections in dependence on the required amount of surplus steam which has to be drawn therethrough so that in the first row maintenance of condensation is assured. This will assure that also in the throttled tubes condensation over the total length thereof is maintained. The throttles will cause a reduction of the surplus amount of steam in dependency on the subsequent arranged size of the tubes through which steam and condensate flow in opposite direction. The cooperation of the first heat exchange means, comprising tubes through which steam and condensate flow in the same direction, and some of which are provided with throttles in the region of the lower ends thereof with the tubes of the second heat exchange means, in which steam and condensate flow in opposite direction, leads, at at least uniform condensation output of the total installation, to a reduction of the number of necessary tubes through which steam and condensate flow in opposite direction and therewith to a reduction of the expenditure for the installation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE of the drawing schematically illustrates the air cooled condenser installation according to the present invention.

DESCRIPTION OF A PREFERRED EMBODIMENT

Referring now to the drawing it will be seen that the air cooled condenser installation according to the present invention comprises first heat exchange means including for instance three rows 4, 5 and 6 of upright tubes 4', 5' and 6' adapted to be impinged by a stream of cooling air, preferably provided by a ventilator 11 which blows such cooling air in the direction as indicated by the arrow A against these tubes. While the schematic drawing shows only the first of the tubes of each of the mentioned rows, it is to be understood that each of the rows 4, 5 and 6 comprises a plurality of tubes arranged parallel and spaced from each other in a direction transverse to the drawing plane. Each tube is provided at its outer surface thereof with vertically spaced annular cooling ribs 8. All of the tubes of the first heat exchange means 3 communicate at upper open ends with a common manifold 2 into which steam to be condensed is fed by a steam conduit 1. The lower open ends of all tubes of the first heat exchange means 3 communicate with a common condensate collecting chamber 7.

Throttles 9 and 10 are respectively provided in the region of the lower ends of the rows of tubes 5 and 6. As can be seen from the drawing no throttles are provided in the tubes 4' of the row of tubes 4, which is first impinged by the stream of cooling air. The throttles 10 in the tubes 5' of the row of tubes 5 have a greater open cross-section than the throttles 9 arranged in the tubes 6' of the row of tubes 6. The condensate accumulating in the collecting chamber 7 is discharged therefrom by a conduit, not shown in the drawing.

The first heat exchange means 3 is operated with surplus steam. The surplus steam which is not condensed in the first heat exchange means 3 passes through a connecting conduit 12 into the lower distribution chamber of second heat exchange means 14. The steam thus supplied to the lower heat distribution chamber 13 of the second heat exchange means 14 flows in upward direction through two rows 15 and 16 of upright tubes 15' and 16', provided at the outer surfaces thereof with vertically spaced annular cooling ribs 8, in upward direction into an upper distribution chamber 17, whereas the condensate thus forming flows countercurrently to the steam downwardly into the chamber 13, from which the condensate is discharged through a conduit, not shown in the drawing.

The upper distribution chamber 17 is closed at one side thereof by wall 18 to thus form a second distribution chamber 19 which is supplied with steam by a branch conduit 20, branching off from the main steam conduit 1. A row 21 of upright tubes 21' communicates at the upper open ends with the distribution chamber 19, whereas the lower ends of the tubes 21' communicate with the lower distribution chamber 13 so that steam flows from the upper distribution chamber 19 downwardly through the tubes 21', in the same direction as the condensate forming in these tubes, into the lower distribution chamber 13. The tubes 21' are likewise provided at the outer surface thereof with annular cooling ribs 8. The tubes of the second heat exchange means 14 are likewise force cooled by a ventilator 22 providing an air stream in the direction as indicated by the arrows B so that the cooling air impinges first on the tubes 21' of the front row of tubes 21, in which steam and condensate flows in the same downward direction from the upper distribution chamber 19 to the lower distribution chamber 13, whereby the cooling air stream which subsequently passes the row of tubes 15 and 16 is preheated. A pump 23 is connected to the upper distribution chamber 17 to suck any air accumulating therein at the end of the condensation process out of the distribution chamber 17.

The magnitude of the open cross-section of the throttles 9 and 10 in the tubes 5' and 6' of the first heat exchange means 3 is dimensioned in such a manner that, in dependence on the flow-through capacity of the row of tubes 15 and 16 of the second heat exchange means 14, through which steam and condensate flow in opposite direction, the condensation process in the row of tubes 4 which are first impinged by the cooling stream A is ensured under all operating conditions and over the total length of these tubes.

It is to be understood that the schematic drawing shows only also for the second heat exchange means 14 only one tube of each row of tubes 15, 16 and 21.

The simplified drawing shows only two heat exchange means 3 and 4 in which the tubes are vertically arranged. Usually, however, a plurality of such heat exchange means are provided which are preferably arranged in the form of a gable roof.

It will be understood that each of the elements described above, or two or more together, may also find a useful application in other types of air cooled condenser installations differing from the types described above.

While the invention has been illustrated and described as embodied in an air cooled condenser installation, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An air cooled condenser installation comprising first heat exchange means comprising a plurality of rows of substantially upright tubes adapted to be impinged by a stream of cooling air in a direction transverse to the longitudinal direction of the tubes, each of the tubes having an upper and a lower open end; an upper manifold communicating with the upper open ends of said tubes; a lower collecting chamber communicating with the lower open ends of said tubes; a steam conduit communicating with said upper manifold so that steam passing therethrough flows downwardly through said tubes to partly condense with the thus-formed condensate flowing likewise downwardly into said lower collecting chamber; second heat exchange means comprising a plurality of second rows of substantially upright tubes adapted to be impinged by a second stream of cooling air flowing transverse to the elongation of said second tubes, each of said tubes in said second rows having an upper and a lower open end; a lower distribution chamber communicating with the lower open ends of the tubes of said second rows; an upper distribution chamber communicating with the upper open ends of the tubes of said second rows; a connecting steam conduit connecting said lower collecting chamber of said first heat exchange means with said lower distribution chamber of said second heat exchange means so that steam which has not been condensed in said first heat exchange means flows upwardly through said tubes of said second rows of tubes from said lower to said upper distribution chamber to thereby condense with the thus-formed condensate flowing in countercurrent direction to the steam; said second heat exchange means including further a plurality of additional substantially upright tubes having each an upper and a lower open end and being arranged in front of the tubes of said second rows to be first impinged by said second stream of cooling air, said additional tubes communicating at the lower ends thereof with said lower distribution chamber; and a branch conduit branching off from said steam conduit and communicating with the upper open ends of said additional tubes so that steam passing therethrough flows downwardly through said additional tubes and condenses with the thus-formed condensate flowing in the same direction as the steam.

2. An air cooled condenser installation as defined in claim 1, wherein each of said tubes is provided with cooling fins projecting from the outer surface thereof.

3. An air cooled condenser installation as defined in claim 1, wherein the plurality of additional tubes are arranged in longitudinal and transverse direction to cover the same area as the tubes of said plurality of second rows.

4. An air cooled condenser installation as defined in claim 1, wherein said plurality of additional tubes form one unit with said plurality of second rows of tubes.

5. An air cooled condenser installation as defined in claim 4, wherein said upper distribution chamber is divided into two compartments, one of which communicates with the upper open ends of said plurality of said second rows of tubes and the other with the upper open ends of said plurality of additional tubes, said branch conduit communicating with said other compartment.

6. An air cooled condenser installation as defined in claim 1, and including throttles arranged in the tubes of said first heat exchange means with the exception of the tubes which are first impinged by the first-mentioned stream of cooling air, said throttles being arranged adjacent said collecting chamber and the open cross-section of the throttles decreases in the direction of the flow of cooling air from one to the next row of tubes.

7. An air cooled condenser installation as defined in claim 1, and including first means cooperating with said first heat exchange means for producing a first stream of cooling air in a direction transverse to the longitudinal direction of the tubes of said first heat exchange means, and second means cooperating with said second heat exchange means for producing a second stream of cooling air in a direction transverse to the longitudinal direction of the tubes of said second heat exchange means and so that said additional tubes are first impinged by said second air stream.

8. An air cooled condenser installation as defined in claim 7, wherein said first and said second means for producing streams of cooling air are constituted by a ventilator.

* * * * *